United States Patent [19]

Sasaki et al.

[11] Patent Number: 4,502,718

[45] Date of Patent: Mar. 5, 1985

[54] AUTOMATIC DOOR LOCKING/UNLOCKING DEVICE FOR AN AUTOMOTIVE VEHICLE

[75] Inventors: Ichiro Sasaki, Yokohama; Yujiro Tsutsui; Masaru Inoue, both of Kamakura; Toru Kase, Yokohama, all of Japan

[73] Assignees: Nissan Motor Company, Limited; Jidosha Denki Kogyo Kabushiki Kaisha, both of Yokohama, Japan

[21] Appl. No.: 364,234

[22] Filed: Apr. 1, 1982

[30] Foreign Application Priority Data

Apr. 15, 1981 [JP] Japan ..... 56-56529

[51] Int. Cl.[3] ..... E05C 3/06

[52] U.S. Cl. ..... 292/336.3; 192/41 S; 292/201; 318/293

[58] Field of Search ..... 70/181, 279, 280; 292/336.3, 201, 144; 200/1 V, 16 D; 318/282, 293; 192/80, 41 S, 81 C

[56] References Cited

U.S. PATENT DOCUMENTS

| | | | |
|---|---|---|---|
| 3,483,955 | 12/1969 | Schell et al. | 192/41 S |
| 3,702,551 | 11/1972 | Blizard | 192/41 S X |
| 3,703,646 | 11/1972 | Jacyno | 200/1 V X |
| 3,947,060 | 3/1976 | Zimmer et al. | 70/279 X |
| 3,947,391 | 3/1976 | Lutzenberger | 200/16 D |
| 4,093,289 | 6/1978 | Inabayashi et al. | 292/336.3 |
| 4,126,341 | 11/1978 | Bradstock | 292/201 |
| 4,135,377 | 1/1979 | Kleefeldt et al. | 70/280 |
| 4,160,389 | 7/1979 | Kubono | 74/89.18 |
| 4,223,256 | 9/1980 | Espenschied | 318/282 |
| 4,270,783 | 6/1981 | Sorensen et al. | 292/336.3 |
| 4,272,112 | 6/1981 | Schlick et al. | 292/201 |
| 4,290,634 | 9/1981 | Gelhard | 292/336.3 X |

FOREIGN PATENT DOCUMENTS

| | | | |
|---|---|---|---|
| 2547291 | 4/1977 | Fed. Rep. of Germany | 318/282 |
| 2948390 | 6/1981 | Fed. Rep. of Germany | 70/279 |
| 2390568 | 5/1978 | France . | |
| 2054725 | 2/1981 | United Kingdom . | |

*Primary Examiner*—Gary L. Smith
*Assistant Examiner*—Russell W. Illich
*Attorney, Agent, or Firm*—Lane, Aitken & Kananen

[57] ABSTRACT

A door lock/unlock system for an automotive vehicle having a safety means for preventing a driving unit for electrically driving a door lock mechanism between a door lock position and an unlock position from being damaged by mis-operation. The safety means inhibits power supply to the driving unit when the door locking operation is made while the door lock mechanism is in the lock position and when the door unlocking operation is made while the door lock mechanism is in the unlock position.

15 Claims, 13 Drawing Figures

AUTOMATIC DOOR LOCKING/UNLOCKING DEVICE FOR AN AUTOMOTIVE VEHICLE

BACKGROUND OF THE INVENTION

The present invention relates generally to an automatic door locking/unlocking device for an automotive vehicle for automatically locking and unlocking the vehicle door. More particularly, the invention relates to the automatic door locking/unlocking device which does not require extremely high accuracy in manufacturing each consisting element and in assembling them to form the door lock mechanism.

The automatic door locking/unlocking device generally includes an electric reversible motor for driving an actuation member to lock and unlock the vehicle door. A door lock/unlock switch can be facilitated adjacent a driver's seat for manual operation by a driver or a passenger in the front seat. The electric motor is responsive to turning on of the door lock/unlock switch to the lock or unlock the door depending upon the switch position. The automatic door lock/unlock device, in turn, permits manual door lock or unlock operation in a per se well known manner.

It will be appreciated that the door lock/unlock switch is not always required for the automatic door locking/unlocking device of the present invention. Namely, the manually operable door lock mechanism of a door beside the driver's seat can be utilized as a driving switch for driving the electric motor, in a fully automatic door lock/unlock system.

In such an automatic door lock/unlock device, a stop mechanism is provided for stopping the electric motor at a predetermined locking and unlocking position to prevent the electric motor from overrunning. In the conventional device, the stop mechanism is adapted to detect a predetermined stroke of the actuation member movement. Therefore, unless the actuation member movement stroke accurately corresponds to the door locking position and unlocking position, the conventional door locking/unlocking device may not work well. If the stop mechanism does not work accurately, it may cause damage to the electric motor.

To obtain an accurate stroke of the actuation member, it is required to manufacture with high accuracy the size and construction of consisting elements in the conventional device. Furthermore, assembling the conventional automatic door locking/unlocking device also requires high accuracy. These requirements necessarily inhibit production of the automatic door locking-/unlocking device and cause a relatively high cost thereof.

SUMMARY OF THE INVENTION

Therefore, it is an object of the present invention to provide an automatic door lock/unlock device for an automotive vehicle which includes a means for preventing the driving unit from driving the door lock mechanism between the locking position and the unlocking position so as to cause damage to the driving unit by inhibiting the driving unit to actuate in the door locking direction while the door locking mechanism is in the locking position and in the door unlocking direction while the door locking mechanism is in the unlocking position.

Another object of the present invention is to provide a switch system for a driving circuit for an automatic door lock/unlock system for an automotive vehicle, which switch system inhibits a power supply to drive the door lock mechanism in a locking or unlocking direction while the door lock mechanism is already in the desired position of the door lock mechanism.

To accomplish the above-mentioned and other objects of the present invention, the door lock/unlock system according to the present invention is provided with a switch movable with an actuation member for operating the door lock mechanism between a locking direction and an unlocking direction. The movable switch is associated with the door lock and door unlock switches for disabling one of the door lock and unlock switches depending on the position thereof. The movable switch is held at the positions respectively corresponding to the door lock position and door unlock position together with the actuation member and held at the moved position even after the actuation member returns to its initial position.

Thereby, the driving unit of the door lock/unlock mechanism of the automotive vehicle is effectively prevented from damage caused by excessively driving the driving unit.

BRIEF DESCRIPTION OF THE DRAWINGS

The present invention will be understood more fully from the description given herebelow and from the accompanying drawings of the preferred embodiment of the present invention, which, however, should not be taken as limitative to the invention but for elucidation and explanation only.

In the drawings.

DESCRIPTION OF THE PREFERRED EMBODIMENT

Figure 1:
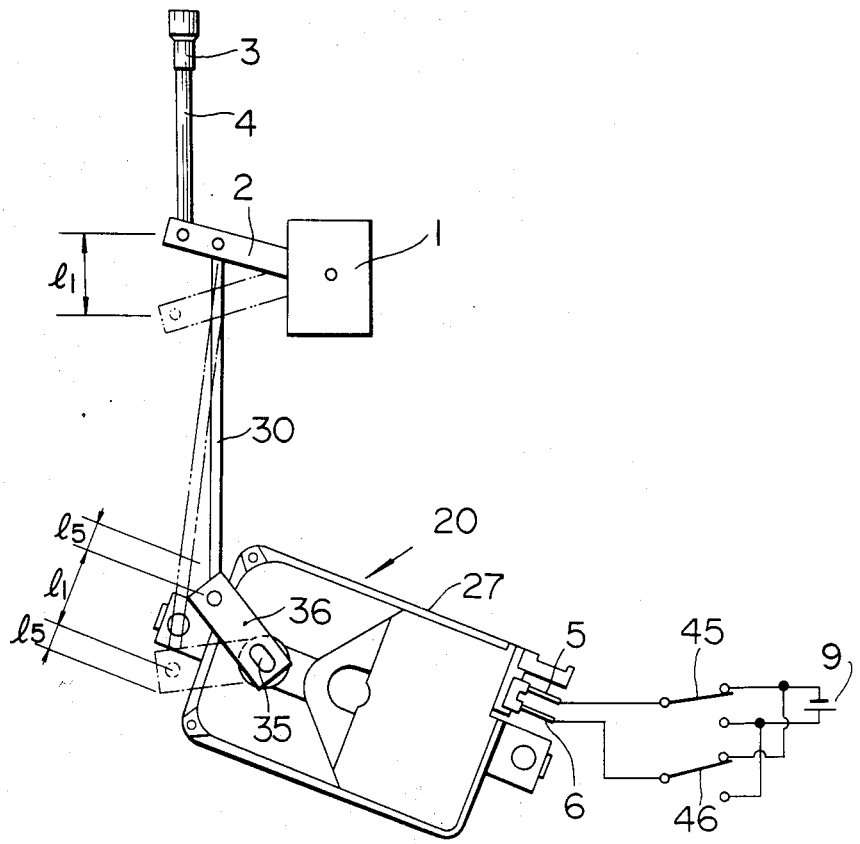
FIG. 1 is a front elevation of the preferred embodiment of a door lock/unlock system according to the present invention.

Referring now to the drawings, particularly to FIG. 1, there is illustrated the preferred embodiment of an automatic door lock/unlock device according to the present invention. The automatic door lock/unlock device generally comprises a door lock mechanism 1 in a per se well known construction, a manually operable door lock knob 3 connected to an actuation rod 2 of the door lock mechanism 1 via a stem 4, an electrically driven actuator 20 having a driving shaft 35 and rotatable arm 36 secured to the driving shaft 35 at one end thereof for rotation therewith. The rotatable arm 36 is connected to the actuation rod 2 of the door lock mechanism 1 via a link 30 in order to operate the door lock mechanism between a door lock position and unlock position. In FIG. 1, the position of the door lock mechanism 1 is illustrated as the unlocked position in the solid line and the locked position in the phantom line. Assuming the stroke of the actuation rod 2 for changing the door lock mechanism position between the lock position and unlock position is $l_1$the rotational stroke $l+2l_5$ of the rotatable arm 36 is provided, as shown in FIG. 1, in order to effect the door lock or unlock operation by the movement of the rotatable arm 36.

The actuator 20 has electric terminals 5 and 6 extending from an actuator housing 27 and respectively connected to a vehicle battery 9 via a door lock switch 45 and a door unlock switch 46. The rotatable arm 36 with the driving shaft 35 is thus rotated in both locking and unlocking directions depending on the switch positions of the door lock switch 45 and the door unlock switch 46.

Figure 2:
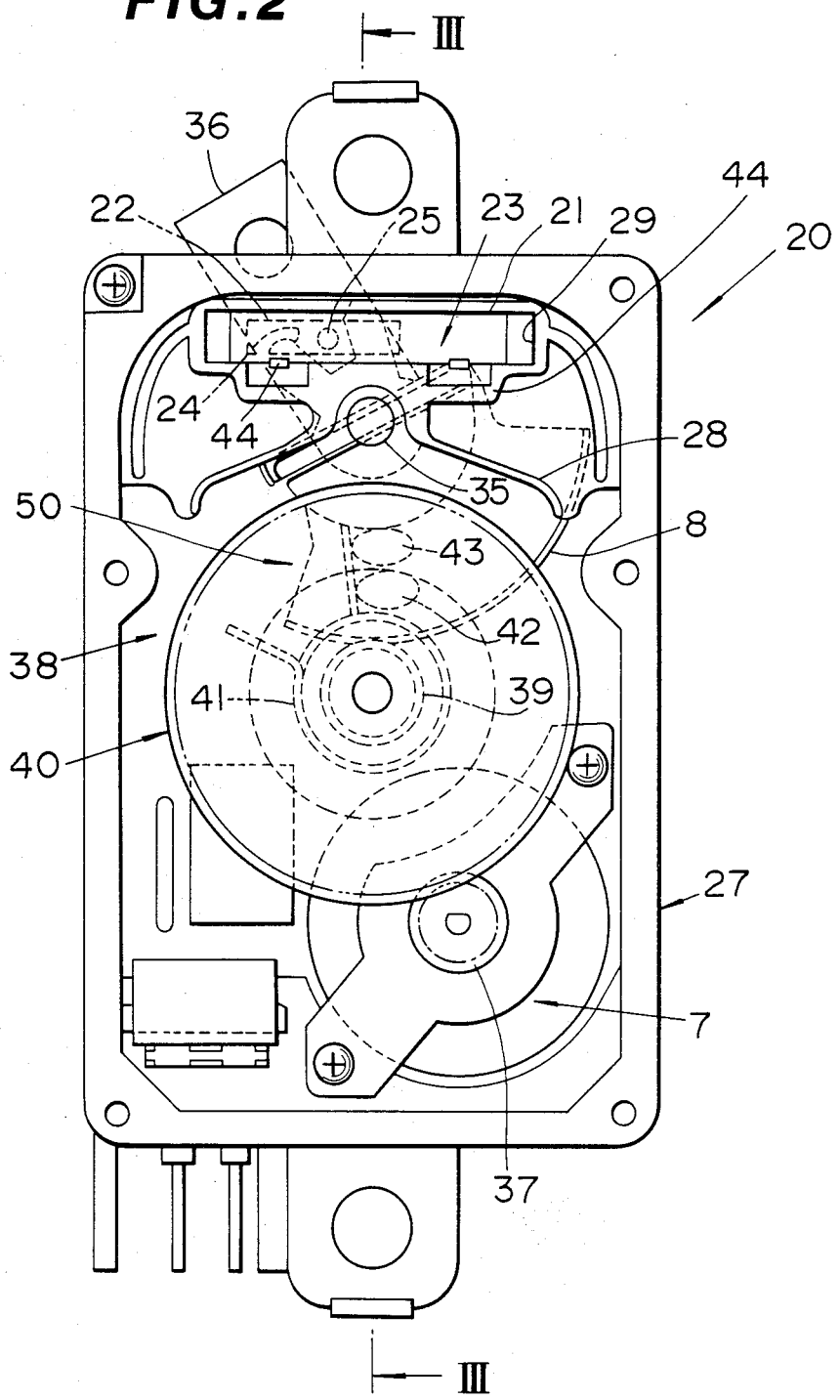
FIG. 2 is an enlarged front elevation of an actuator in the door lock/unlock system of FIG. 1, wherein a top plate of an actuator housing is removed to show the internal construction of the actuator.
Figure 3:
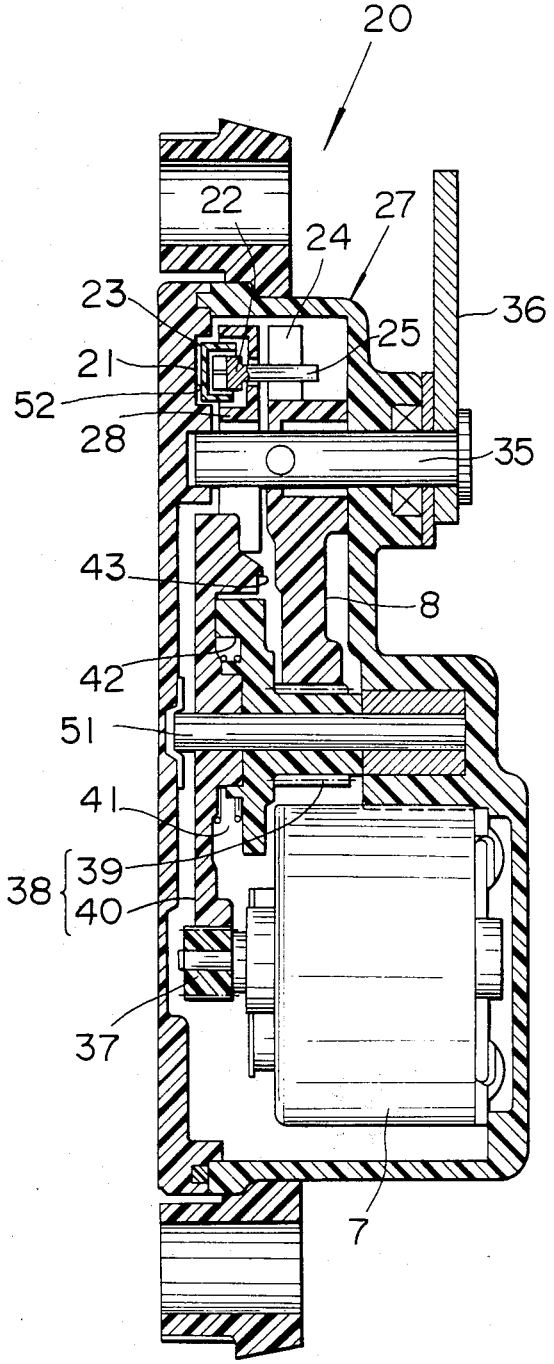
FIG. 3 is a cross-section of the actuator of FIG. 2 taken along line III—III of FIG. 2.
Figure 4:
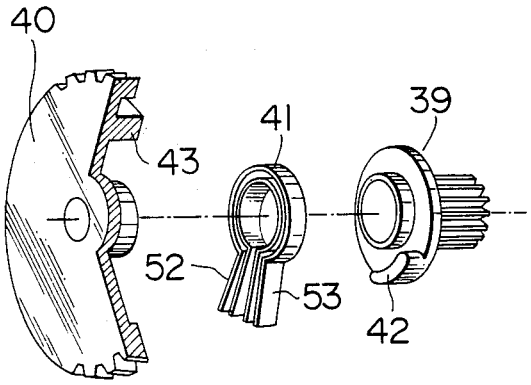
FIG. 4 is an exploded perspective view of an interengagement mechanism in the actuator of FIG. 2.

As shown in FIGS. 2 and 3, the driving shaft 35 is connected to a drive pinion 37 of an electrically driven reversible motor 7 via a reduction gear assembly 38 and a rack member 8. The reduction gear assembly 38 includes an idler gear 40 and an idler pinion 39 rotatably mounted on a common axle 51. The idler gear 40 has a larger diameter than the idler pinion 39 and is associated with the latter with an interengagement mechanism 50. As shown in FIG. 4, the interengagement mechanism 50 comprises a spring 41 inserted in a recess formed on one surface of the idler gear 40. The spring 41 has a generally circular configuration and has ends 52 and 53 extending from the major section of the spring. The ends 52 and 53 are normally urged in a direction away from each other. The idler gear 40 has a projection 43 protruding into the recess so that it may abut against one of the ends 52 and 53 of the spring 41. On the other hand, the idler pinion 39 is formed with a projection 42 projecting toward the recess of the idler gear 40. The projection 42 is adapted to abut against one of the ends 52 and 53 while the idler pinion 39 is rotated.

This interengagement mechanism construction permits the idler pinion 39 to rotate independently of the idler gear 40. As the idler pinion 39 is operated to rotate by the door lock knob 3 via the rack member 8, the door lock knob 3 can be manually operated independently of the motor 7 to reduce the required manual operation force.

As shown in FIGS. 2 and 3, a stop switch 21 is provided for detecting the end of the rotational movement of the rack member 8 and for stopping the drive of the motor 7. The stop switch 21 generally comprises a movable contactor holder 22 with a pin 25 protruding therefrom and engageable with a cut-out 24 formed in the rack member 8 and a terminal block 23 which is received in a recess 52 and 29 respectively formed in a housing 27 and a switch casing 28. The switch casing 28 is formed with a pair of projections 44 to resiliently hold the terminal block 23 in the recess 29.

Figure 5:
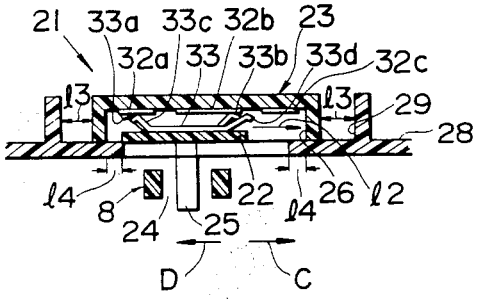
FIG. 5 is a further enlarged section of a switch means in the actuator of FIG. 2.
Figure 6:
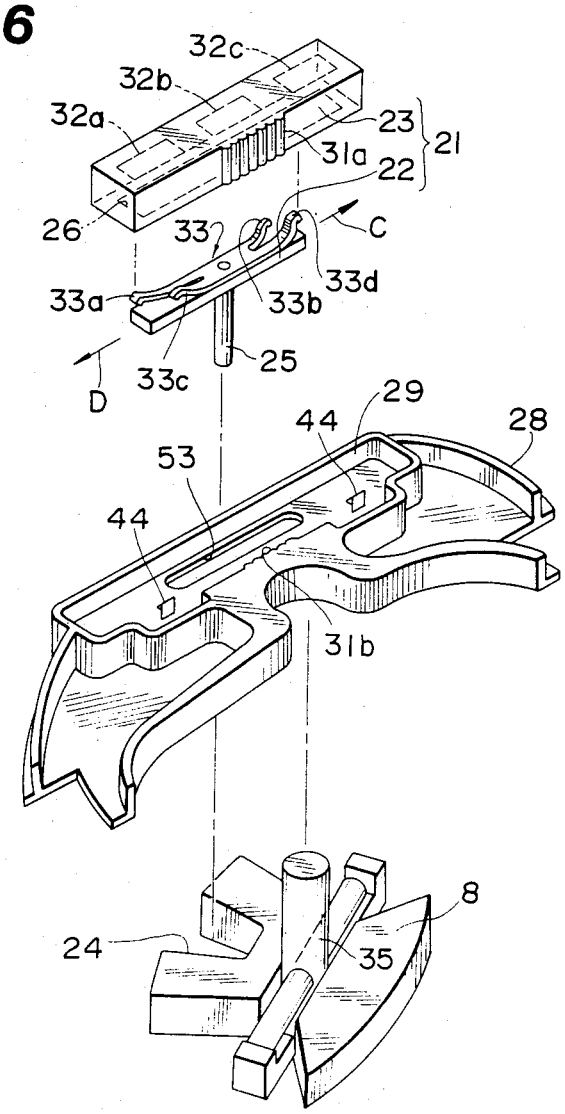
FIG. 6 is a perspective view of the switch means of FIG. 5 in which the switch means is illustrated with a rack member of the actuator.

As shown in FIGS. 5 and 6, the movable contactor holder 22 is attached with a contactor 33. The contactor 33 has four terminals **33*a*, 33*b*, 33*c* and 33*d* respectively bent away from the contactor holder 22. The pin 25 of the contactor holder 22 extends through an elongated opening 53 formed in the switch casing 28 so that the contactor holder 22 can move along the elongated opening 53. Stationary terminals 32*a*, 32*b* and 32*c* are secured on the inner surface of the terminal block 23. The contactor holder 22 with the contactor 33 is received in a recess 26 of the terminal block 23 to mate the terminals 33*a*, 33*b*, 33*c* and 33*d* thereof to the stationary terminals 32*a*, 32*b* and 32*c*. The terminals 33*a*, 33*b*, 33*c* and 33*d* of the contactor 33 and the stationary terminals 32*a*, 32*b* and 32*c* are so related that the contactor 33** always bridges two of the three stationary terminals by contacting at least two of the four terminals to each of two stationary terminals.

The terminal block 23 is movable with respect to the recess 29 of the switch casing. The terminal block 23 is formed with teeth **31*a* on the outer periphery thereof. On the other hand, the switch casing 28 is formed with teeth 31*b* engageable with the teeth 31*a* of the terminal block 23. The teeth 31*a* and 31*b* constitute a positioning means for positioning the terminal block 23 in the recess 29**.

Figure 7:
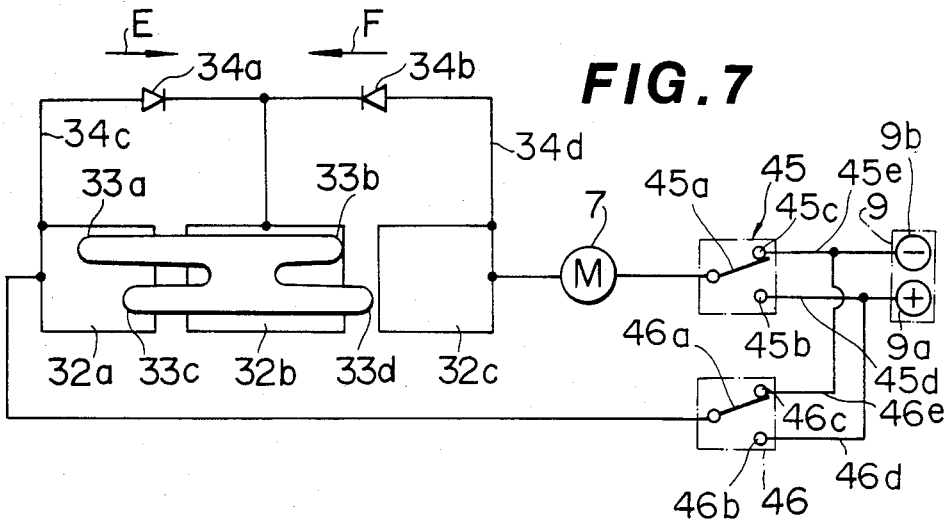
FIG. 7 is a circuit diagram of a driving circuit for the actuator, which illustrates a switch position corresponding to the unlocking position of the door lock mechanism.
Figure 8:
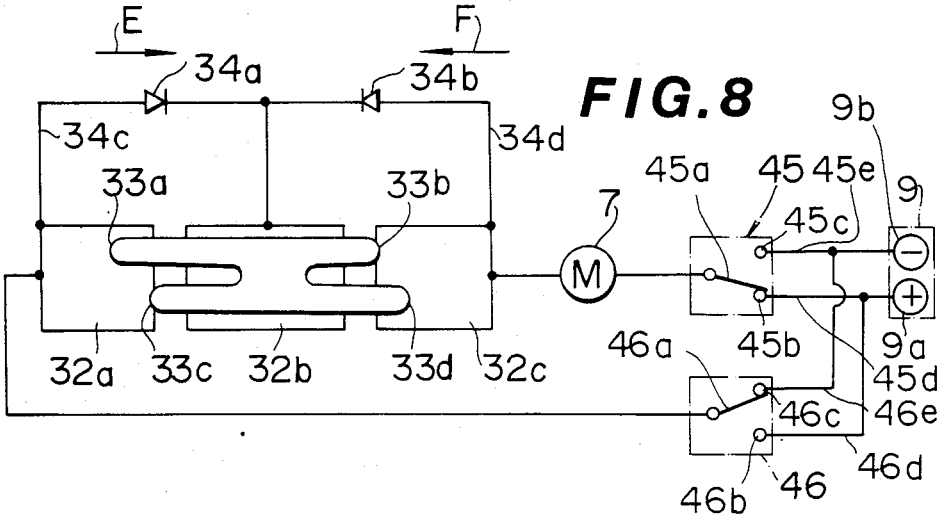
FIG. 8 is a circuit diagram similar to FIG. 7 showing the switch position intermediate between the locking position and unlocking position.
Figure 9:
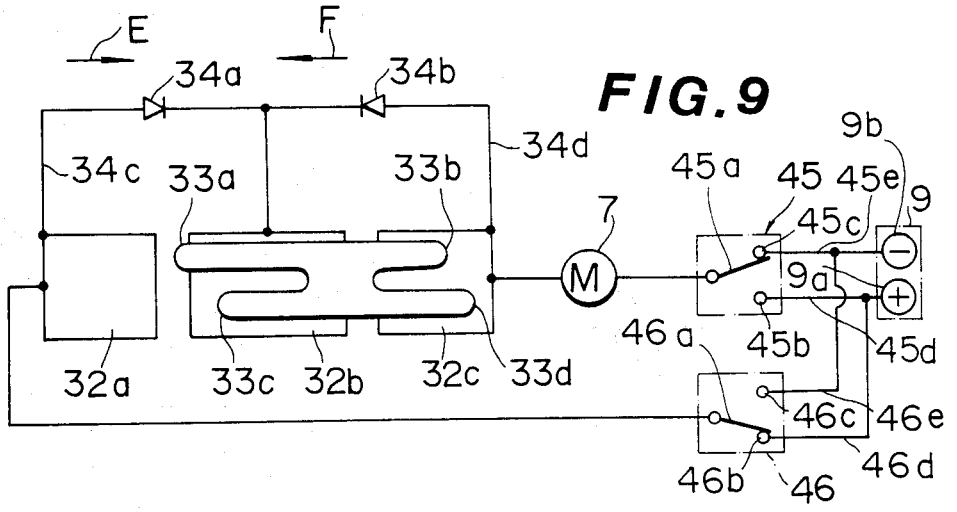
FIG. 9 is a circuit diagram similar to FIG. 7 showing the switch position corresponding to locking position of the door lock mechanism.

FIGS. 7 to 9 illustrate a driving circuit of the motor 7 in the in locking and unlocking positions. The stationary terminal **32*a* is connected to the vehicle battery 9 via the door unlock switch 46. On the other hand, the stationary terminal 32*c* is connected to the vehicle battery 9 via the motor 7 and the door lock switch 45. The stationary terminal 32*b* is connected to the stationary terminals 32*a*, 32*c* via lines 34*c* and 34*d* with diodes 34*a* and 34*b*. The diodes 34*a* and 34*b* serve as safety means for preventing the motor 7** from being driven in the door locking direction while the door lock mechanism is in the locking position or in door unlocking direction while the door locking mechanism is in the unlocking position.

The door lock switch 45 has a switching member **45*a* and terminals 45*b* and 45*c*. The terminal 45*b* is connected to the positive terminal 9*a* of the vehicle battery via a line 45*d* and the terminal 45*c* is connected to the negative terminal 9*b* of the vehicle battery 9 via a line 45*e*. Likewise, the door unlock switch 46 has a switching terminal 46*a* and terminals 46*b* and 46*c*. The terminal 46*b* is connected to the positive terminal 9*a* of the vehicle battery 9 via lines 46*d* and 45*d* and the terminal 46*c* is connected to the negative terminal 9*b* of the vehicle battery 9 via lines 46*e* and 45*e*. The switching members 45*a* and 46*a* are normally urged to the terminals 45*c* and 46*c* to be connected to the negative terminal 9*b*** of the vehicle battery.

With the actuator 20 positioned as shown in FIG. 2, the door lock mechanism 1 is in the unlocking position. In this position, if the door lock switch 45 is turned to contact the switching member **45*a* to the terminal 45*b*, as shown in FIG. 8, the driving circuit for the reversible motor 7 is completed to drive the motor in the counterclockwise direction in relation to FIG. 2. The drive pinion 37 is thus rotated counterclockwise to drive the idler gear 40 clockwise. The idler pinion 39 is rotated clockwise together with the idler gear 40 via the spring 41 to drive the rack member 8 counterclockwise. By the counterclockwise rotation of the rack member 8, the driving shaft 35, to which the rack member is fixedly secured, is rotated together with the rotatable arm 36** into the position shown in FIG. 10. By the rotation of the rotatable arm 36, the actuation rod 2 of the door lock mechanism 1 is pulled downwardly to place the door lock mechanism at the locking position.

At this time, the movable contactor holder 22 connected to the rack member 8 with the pin and cut-out engagement is moved along the recess 26 of the terminal block. Assuming the contactor holder 22 is positioned at the position shown in FIG. 6 to connect the stationary terminals 32*a* and 32*b* while the door lock mechanism 1 is maintained at the unlocking position of FIG. 2, the movable contactor holder 22 moves to the right to establish electrical communication between the stationary terminals 32*b* and 32*c* with the contactor 33 as shown in FIG. 9. During this movement, the contactor 33 is placed in the position shown in FIG. 8. In the position of FIG. 8, the contactor 33 connects the stationary terminal 32*a* to the stationary terminal 32*c* to keep the power supply to the motor. At the contactor position of FIG. 8, the diode 34*a* blocks electric current flow therethrough to stop driving of the motor 7.

As long as the contactor 33 is kept at the position shown in FIG. 9, the door lock switch 45 is disabled to further operate the actuator.

According to the rotational movement of the rack member 8, the movable contact holder 22 is moved by an amount $l_2$ of FIG. 5 to move the contact 33 from the position shown in FIG. 7 to the position shown in FIG. 9. At the contactor position shown in FIG. 9, the contactor holder 22 is placed at a position to leave a clearance $l_4$ between it and the adjacent periphery of the terminal block 23.

Figure 10:
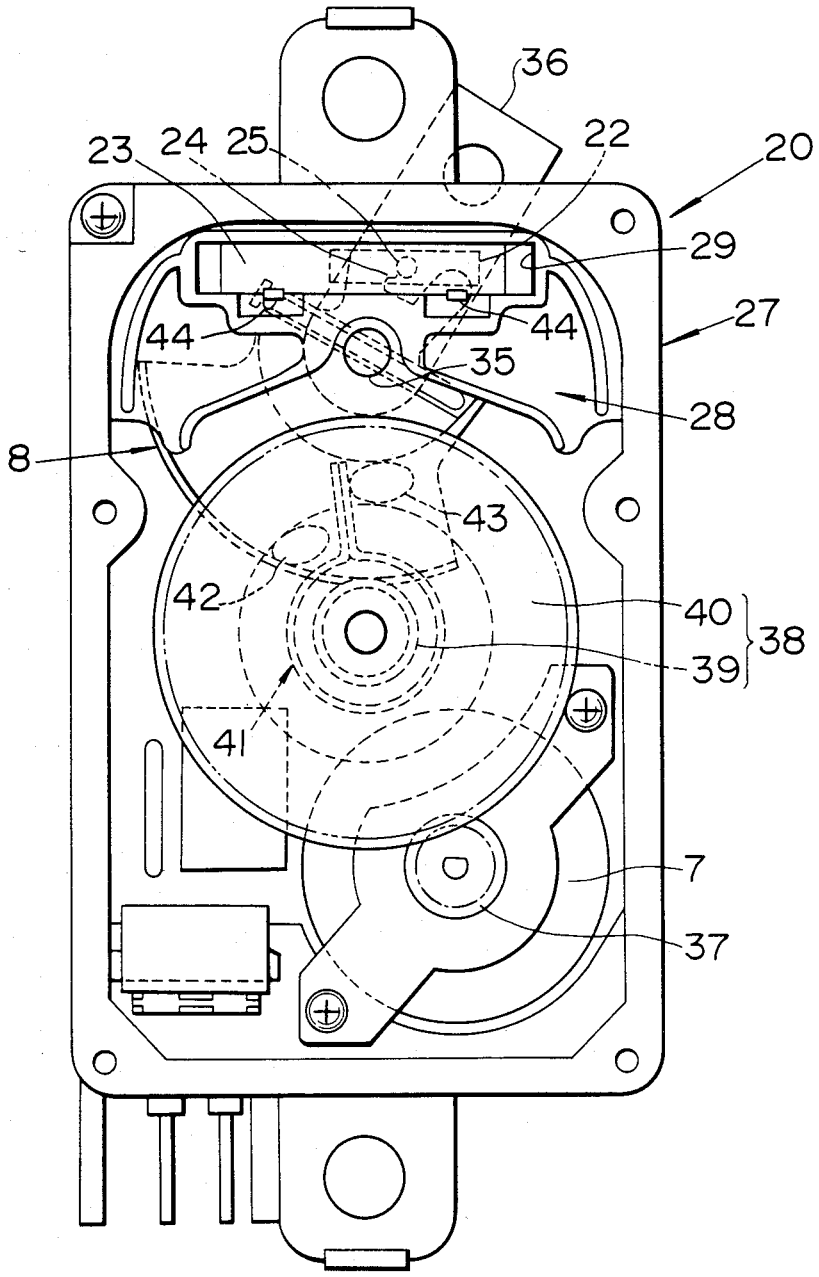
FIG. 10 is a front elevation similar to FIG. 2 showing the locking position of the actuator.
Figure 13:
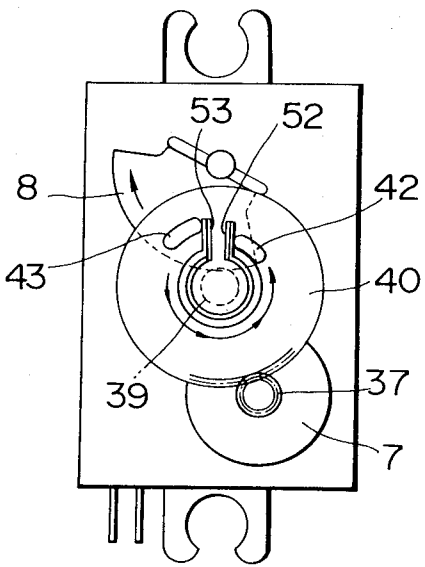
FIGS. 11 to 13 are fragmentary illustration showing functions of the interengagement mechanism of FIG. 4.
Figure 12:
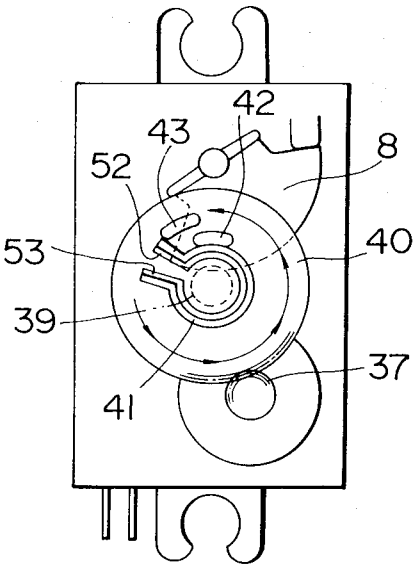
Figure 11:
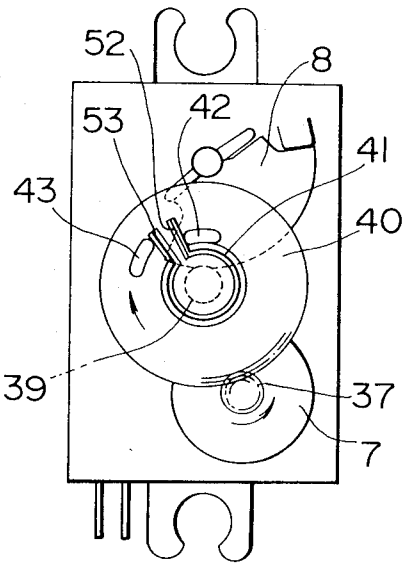

In this door unlocking position, the projection 43 of the idler gear 40 abuts against the end 53 of the spring 41 and, in turn the projection 42 of the idler pinion 39 abuts against the end 52 of the spring 41, as shown in FIG. 11. In this position, the spring 41 accumulates the spring force to rotate the idler gear 40 counterclockwise, when the motor 7 cease driving, as shown in FIG. 12. At the position shown in FIG. 12, the rack member 8, the rotatable arm 36, and the door lock mechanism 1 is maintained at the door unlocking position. When the door lock knob 3 is manually pushed down, the rack member 8 is rotated clockwise independently of the idler gear 40 to permit the door lock mechanism 1 to move to door locking mechanism, as shown in FIG. 13. Here, since the idler pinion 39 and the spring 41 can rotate independently of the idler gear 40, the operational force for pushing down the door lock knob 3 is satisfactorily reduced. This interengagement mechanism position corresponds to the actuator position as illustrated in FIG. 10.

In a switch position as illustrated with the phantom line in FIG. 1, the door lock mechanism 1 is in the locked position. At this position, even if the door lock switch 45 is turned to contact the switching member 45*a* to the terminal 45*b*, as shown in FIG. 9, since the movable contactor 33 is positioned at the position as shown in FIG. 9, the driving circuit for the reversible motor 7 does not supply power to the motor to drive same in the locking or clockwise direction of FIG. 2. At this position, the power is supplied to the reversible motor 7 in response to turning on of the door unlocking switch 46 to connect the switch member 46*a* to the terminal 46*b*. The drive pinion 37 is thus rotated counterclockwise to drive the idler gear 40 clockwise. The idler pinion 39 is rotated clockwise together with the idler gear 40 via the spring 41 to drive the rack member 8 counterclockwise. By the counterclockwise rotation of the rack member 8, the driving shaft 35 to which the rack member is fixedly secured is rotated together the rotatable arm 36. By the rotation of the rotatable rod 36, the actuation arm 2 of the door lock mechanism 1 is pushed upwardly to place the door lock mechanism at the unlocking position, as shown in FIG. 2. At this position, the contactor 33 is placed at the position of FIG. 7.

In assembling the actuator 20, the terminal block 23 is positioned to place the stationary terminals 32*a*, 32*b* and 32*c* at an appropriate location with respect to the contactor 33 according to the door lock mechanism position. Here, since the terminal block 23 is so related to the switch casing 28 as to have a clearance $l_3$ between the opposing periphery of the terminal block and the recess 29, the adjustment of the relationship in position of the contactor 33 and the stationary terminals 32*a*, 32*b* and 32*c* can be done by moving the terminal block. At this time, the teeth 31*a* and 31*b* of the terminal block 23 and the switch casing 28 serves to fix the terminal block at the adjusted position.

While the present invention has been illustrated hereabove with respect to the specific embodiment, the invention should not be understood to be limited in the specific embodiment as set forth but includes all of the possible modifications without departing from the principle of the invention.

What is claimed is:

1. A door lock/unlock system for an automotive vehicle comprising:

a mechanically operable door lock mechanism operable between a door lock position and a door unlock position;

an electrically operable actuator including:

an electrical driving means mechanically connected to said door lock mechanism for operating said door lock mechanism between said door lock and unlock positions; and a first switch including a movable switch member coupled to said driving means for movement according to a driving operation of said driving movement either in a door locking direction or in a door unlocking direction, and having a first and second position settable respectively corresponding to the door unlock and lock positions of the door lock mechanism; and a driving circuit connecting said driving means to an electric power source, said circuit having a second switch switchable between a first position in which said driving means is driven for operating said door lock mechanism in said door locking direction and a second position in which said driving means is driven for operating said door lock mechanism in said door unlocking direction, said second switch associated with said first switch for establishing electrical communication between said power source and said driving means during one of at least two switch conditions in which said first switch is in said first position and said second switch is in said first position, and said first switch is in said second position, and said second switch is in said second position, and for blocking electrical communication between said power source and said driving means during switch conditions in which said first switch is in said first position and said second switch is in said second position or said first switch is in said second position and said second switch is in said first position.

2. A door lock/unlock system for an automotive vehicle comprising:

a door lock mechanism coupled to a manually operable door lock knob for operation between a door lock position and a door unlock position;

an electrically operable actuator mechanically coupled to said door lock mechanism to operate the latter between said door lock and unlock positions, said actuator including an electrically operable driving means operable in alternative door locking and unlocking directions for operating said door lock mechanism to move to said door lock position and to said door unlock position;

a first switch incorporated with said actuator and having a movable switch member coupled to said electrically operable actuator and accordingly operable between a first and second position respectively corresponding to the door lock and unlock positions of the door lock mechanism, said switch member associated with said driving means to be driven in said door locking and unlocking directions depending upon a driving direction of the driving means and moving from said first position to said second position as driven in said door locking direction and from said second position to said first position as driven in said door unlocking direction; and a driving circuit connecting said driving means in said actuator to an electric power source, said circuit having a second switch switchable between a first position in which said driving means is driven for operating said door lock mechanism in said locking direction and a second position in which said driving means is driven for operating said door lock mechanism in said door unlocking direction, said second switch associated with said first switch to disable the driving means for operating said lock mechanism in said door locking direction while said first switch is in said first position and to disable the driving means for operating said door lock mechanism in said door unlocking direction while said first switch is in said second position.

3. The system as set forth in claim 1 or 2, wherein said first switch comprises a movable switch associated with said driving means for movement in door locking and unlocking directions according to the driving direction of said driving means, first and second stationary switch members respectively located to contact with said movable switch member at respective first and second positions.

4. The system as set forth in claim 3, wherein said movable switch member is responsive to the door lock or unlock position of said door lock mechanism to move to said second or first positions depending upon the position of said door lock mechanism.

5. The system as set forth in claim 3, wherein said actuator includes a portion movable by said driving means between first and second positions, and means coupling said movable portion with said door lock mechanism, said first and second positions of said movable portion corresponding respectively to said door lock and unlock positions of said door lock mechanism, and said movable portion associated with said movable switch member for operating the latter in said door locking and unlocking directions.

6. The system as set forth in claim 5, wherein said movable portion includes means for holding said movable switch member in said first and second positions thereof corresponding to door lock and unlock positions of said door lock mechanism.

7. The system as set forth in claim 6, wherein said first and second stationary switch members are so arranged that said second stationary switch member contacts with said movable switch member at the end of movement of said door lock mechanism in the door locking direction, which one end corresponds to said door lock position of said door lock mechanism and said first stationary switch member is disconnected from said movable switch member thereupon, and that said first stationary switch member contacts with said movable switch member at the other end of movement of said door lock mechanism in said door unlocking direction, which other end corresponds to the door unlocking position of said door lock mechanism and said second stationary switch member is disconnected from said movable switch member thereupon.

8. The system as set forth in claim 5, wherein said driving means includes decoupling means for permitting said door lock mechanism to be manually locked and unlocked without operation of said driving means.

9. A door lock/unlock system for an automotive vehicle having a mechanically operable door lock mechanism adapted for operation between a door lock and a door unlock position and an electrically operable actuator operating the door lock mechanism between the door lock and unlock positions, said actuator having a reversible motor operable in a first and a second direction respectively corresponding to the lock and unlock positions of the door lock mechanism, said system comprising:

a first switch including a movable switch member coupled to said actuator associated with said reversible motor and movable between a first and a second position in accordance with an operating direction of the actuator associated with said reversible motor in one of said door lock and unlock directions, said movable switch member being slidingly movable in said door lock and unlock directions for switching switch positions between a first position in which said movable switch contacts to a first stationary switch member at said door lock position of said door lock mechanism and a second position in which said movable switch member contacts a second stationary switch member at said door unlock position of said door lock mechanism, said first switch further including means for holding said movable switch member in one of said first and said second positions which respectively corresponds to the position of the door lock mechanism; and a circuit including a second switch, said reversible motor and said first switch, said second switch manually operable to supply electric power in said circuit in alternative directions for the reversible motor to operate said reversible motor in said first and second directions thereby operating said actuator in said door lock and unlock directions respectively, said circuit preventing connection of said power supply to said motor when the second switch is operated to actuate said reversible motor in said first direction while the door lock mechanism is in said lock position and to prevent connection of said power supply to said reversible motor when the second switch is operated in said second direction while the door lock mechanism is in the unlocking position.

10. The system as set forth in claim 9, which further comprises means for coupling said movable switch member to said actuator for operating the movable switch member according to the movement of said door lock mechanism.

11. The system as set forth in claim 10, wherein said movable switch member is kept in contact with said first stationary switch member during the door unlocking direction movement of said door lock mechanism and with said second stationary switch member during the door locking direction movement of said door lock mechanism.

12. The system as set forth in claim 11, wherein said coupling means comprises a rack member driven in said door locking and unlocking direction corresponding to movement of said door lock mechanism in said door locking and unlocking mechanism.

13. The system as set forth in claim 12, wherein said actuator further comprises a reduction gear and said rack member, said reduction gear is incorporated between said reversible motor and said rack member so that it drives the rack member in first and second directions corresponding to said door lock and unlock directions of said reversible motor.

14. The system as set forth in claim 13, wherein said reduction gear comprises a pair of idler gears interconnected via a spring biased coupling means for permiting the rack member to move independently of the motor rotation while said door lock mechanism is manually operated.

15. A door lock/unlock system for an automotive vehicle comprising:

a door lock mechanism coupled to a manually operable door lock knob for operation between a door lock position and a door unlock position;

an electrically operable actuator mechanically coupled to said door lock mechanism to operate the latter between said door lock and unlock positions, wherein said actuator includes a portion movable by said driving means between first and second positions, and means coupling said movable portion with said door lock mechanism, said first and second positions of said movable portion corresponding respectively to said door lock and unlock positions of said door lock mechanism, and said movable portion is coupled with said first switch to move said first switch between said first and second positions thereof, and said first switch includes means for holding said first switch in said first and second positions thereof;

a first switch incorporated with said actuator and operable between a first and second position respectively corresponding to the door lock and unlock positions of the door lock mechanism, said first switch associated with said driving means to be driven in said door locking and unlocking directions depending upon a driving direction of the driving means and moving from said first position to said second position as driven in said door locking direction and from said second position to said first position as driven in said door unlocking direction; and a driving circuit connecting said driving means in said actuator to an electric power source, said circuit having a second switch switchable between a first position in which said driving means is driven for operating said door lock mechanism in said locking direction and a second position in which said driving means is driven for operating said door lock mechanism in said door unlocking direction, said second switch associated with said first switch to disable the driving means for operating said lock mechanism in said door locking direction while said first switch is in said first position and to disable the driving means for operating said door lock mechanism in said door unlocking direction while said first switch is in said second position.

* * * * *